US009777454B1

(12) United States Patent
Shin

(10) Patent No.: US 9,777,454 B1
(45) Date of Patent: Oct. 3, 2017

(54) REMOVABLE GROUND ANCHOR BODY USING ROTATION

(71) Applicants: Samjin Steel Ind. Co., Ltd., Gimpso-si, Gyeonggi-do (KR); Hyun Taik Shin, Bucheon-si (KR)

(72) Inventor: Hyun Taik Shin, Bucheon-si (KR)

(73) Assignees: Samjin Steel Ind. Co., Ltd., Gimpo-si (KR); HYUN TAIK SHIN, Bucheon-si (KR)

( * ) Notice: Subject to any disclaimer, the term of this patent is extended or adjusted under 35 U.S.C. 154(b) by 0 days.

(21) Appl. No.: 15/340,696

(22) Filed: Nov. 1, 2016

(30) Foreign Application Priority Data

Jul. 26, 2016 (KR) ..... 10-2016-0094699

(51) Int. Cl.
*E02D 5/80* (2006.01)

(52) U.S. Cl.
CPC ..... *E02D 5/80* (2013.01); *E02D 5/805* (2013.01); *E02D 2200/146* (2013.01); *E02D 2220/00* (2013.01); *E02D 2300/002* (2013.01); *E02D 2300/0034* (2013.01); *E02D 2600/30* (2013.01)

(58) Field of Classification Search
CPC ..... E02D 5/80; E02D 17/202; E21D 21/0033
USPC ..... 405/259.1, 262, 284, 302.4
See application file for complete search history.

(56) References Cited

U.S. PATENT DOCUMENTS

2005/0050817 A1* 3/2005 Shin ..... E04C 5/122 52/223.1

FOREIGN PATENT DOCUMENTS

KR 10-0963565 B1 6/2010
KR 10-1471486 B1 12/2014

* cited by examiner

*Primary Examiner* — Sean Andrish
(74) *Attorney, Agent, or Firm* — Novick, Kim & Lee, PLLC; Jae Youn Kim

(57) ABSTRACT

Provided is a removable ground anchor body using a rotation wherein when a pc strand or a deformed steel bar is rotated, a screw bar is interlock-rotated to raise an operation member and sequentially raise a body and a wedge from the pc strand or the deformed steel bar thereby to release the connection state.

4 Claims, 7 Drawing Sheets

REMOVABLE GROUND ANCHOR BODY USING ROTATION

CROSS-REFERENCE TO RELATED APPLICATION(S)

This application claims benefit of priority to Korean Patent Application No. 10-2016-0094699 filed on Jul. 26, 2016, in the Korean Intellectual Property Office, the disclosure of which is incorporated herein by reference in its entirety.

BACKGROUND

1. Field

The present invention relates to a removable ground anchor body using rotation, and more particularly, to a removable ground anchor body using rotation in which pc (prestressed concrete) strands or deformed steel bars coupled to an anchor body can be separated and removed simply, a safe coupling state thereof can be sustained continuously and they can be re-coupled conveniently while they are separated.

2. Description of Related Art

Generally, a slope reinforcement structure is used widely for supporting safely a structure such as an earth retaining wall at a soil sheathing work so as to prevent collapse of surrounding ground when excavating the ground for underground structures of an architecture and a civil engineering work or at a work for prohibiting soil sweeping of soft ground incision face thereof, through ensuring strong anchorage by perforating holes on a ground, inserting steel wire having an excellent tensile strength together with inner fixing agent and inner inserted body into the perforated holes, injecting grouting material such as concrete therein and fixing firmly, and then fixing it with external fixing agent while applying load on a free end of the steel wire.

The steel wire used for the slope reinforcement structure is made by twisting a several strands of deformed steel bars or steel wires wherein the deformed steel bar or the steel wire have excellent strength and thus may become an underground obstacle in a case of leaving it underground for a long time and cause a problem of a ground compensation right in a case of later development of adjacent land.

In order to solve the above problem a removable inner anchorage for ground anchor has been disclosed, in which a deformed steel bar or steel wire buried underground is removed easily after a construction complement.

According to the conventional anchor body, a slope surface is formed on an inner side of a circular body and a wedge is provided, which is divided roughly into three pieces and at a center of which a steel wire is seated, a elastic spring for compressing the wedge forward is provided at a rear end of the wedge such that the detachment and separation of the steel wire cab be prevented by compressing the wedge.

However, according to the conventional anchor structure, the steel wire can be removed while retracting the wedge provided at an inner side of a circular body and enlarging a center thereof by compressing the steel wire wherein even though the wedge is retracted, it cannot be enlarged and further even though the wedge is retracted and enlarged, the spring provided at a rear end thereof compresses continuously the wedge, which becomes a burden on removing the steel wire, and thus the separation is not complete.

Further, it is almost impossible to re-assemble at a site the anchor body which has been disassembled due to external impact, causing inconvenience for implementing the construction.

In order to solve the above problems the present applicant disclosed Korean Patent Nos. 0963565 and 1471486.

SUMMARY

An object of the present invention relates to provide a removable ground anchor body using a rotation in which a pc strand or a deformed steel bar connected to the anchor body is separated and removed simply.

Another object of the present invention relates to provide a removable ground anchor body using a rotation in which the anchor body is connected fully to a pc strand or a deformed steel bar and the connection state can be kept continuously and safely.

Another object of the present invention relates to provide a removable ground anchor body using a rotation in which even though a pc strand or a deformed steel bar is separated from an anchor body, they can be re-connected simply regardless of places.

In order to achieve the above objects a removable ground anchor body using a rotation of the present invention may include: an operation member on which a screw bar to be connected to screw grooves of a water-proof cap is formed and an octagonal flange is formed on a lower side of the screw bar, from a lower end to upward of which a guide groove is formed; and a body which is provided with a compression spring to be inserted into the guide groove of the operation member, on a lower part of which a wedge connection portion is formed and on an upper part of which an operation portion is formed wherein a key groove and an idle portion are formed up and downward on the operation portion such that the octagonal flange of the screw bar is inserted into the key groove and the idle portion to correspond selectively to the key groove and the idle portion depending on the location of the octagonal flange.

BRIEF DESCRIPTION OF DRAWINGS

The summary described above as well as the detailed description of the preferred embodiments of the present application which will be described below will be more clearly understand when read in conjunction with the accompanying drawings. The preferred embodiments are illustrated in the drawings for the purposes for illustrating the present invention. However, it should be understood that the present application is not limited to the illustrated accurate arrangements and means.

DETAILED DESCRIPTION

Figure 1:
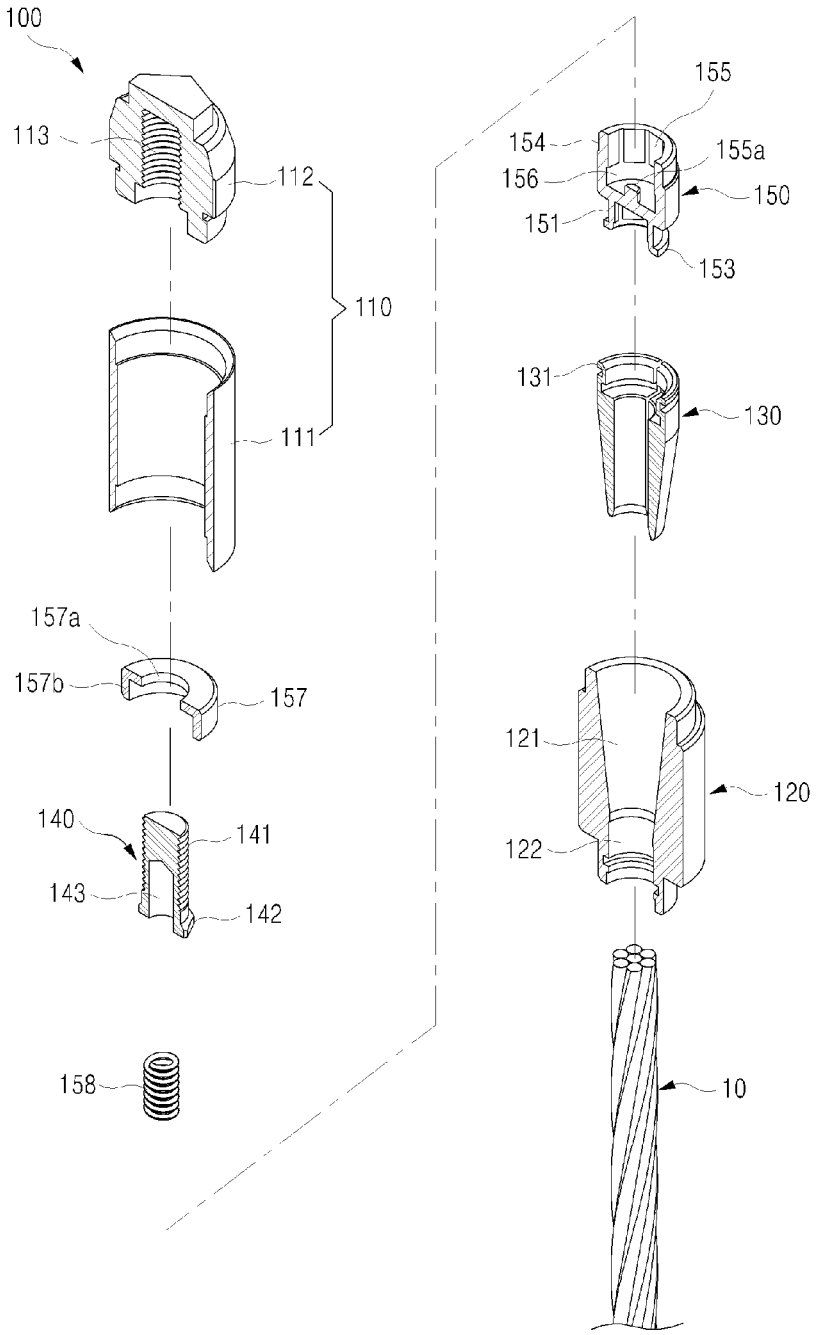
FIG. 1 is an exploded-perspective view illustrating a removable ground anchor body using a rotation according to an embodiment of the present invention.
Figure 2:
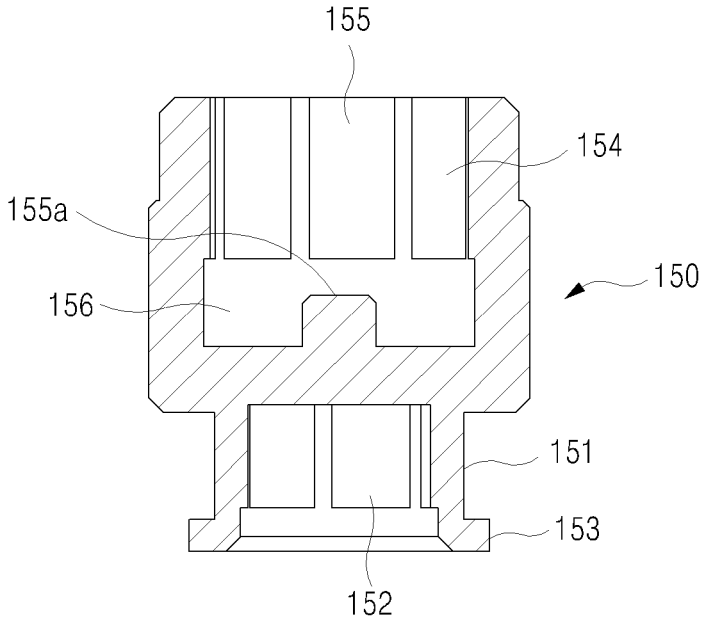
FIG. 2 is an enlarged-sectional view illustrating a removable ground anchor body using a rotation according to an embodiment of the present invention.
Figure 3:
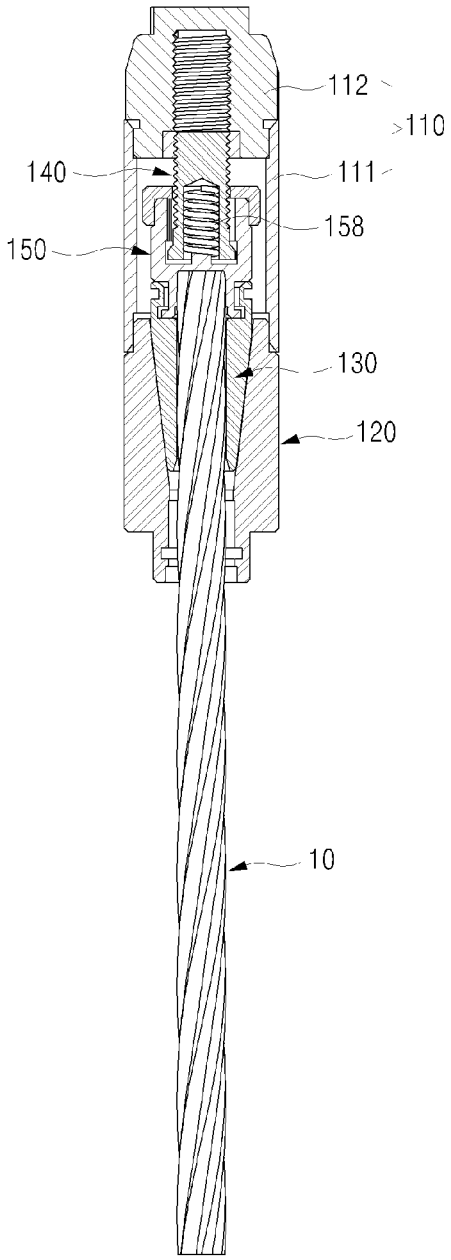
FIG. 3 is a connected-sectional view illustrating a removable ground anchor body using a rotation according to an embodiment of the present invention.
Figure 4:
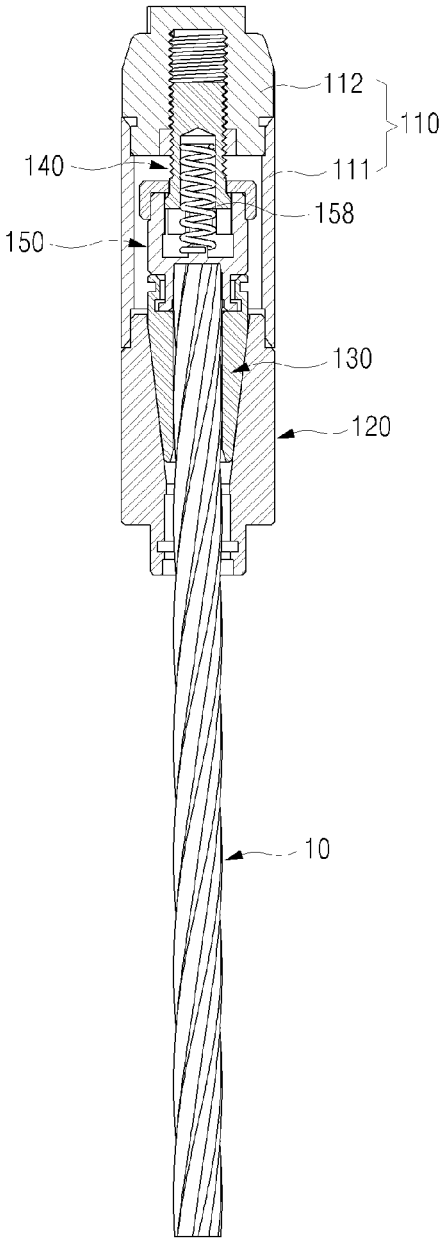
FIG. 4 is a sectional view illustrating an initial state of a removable ground anchor body using a rotation according to an embodiment of the present invention.
Figure 5:
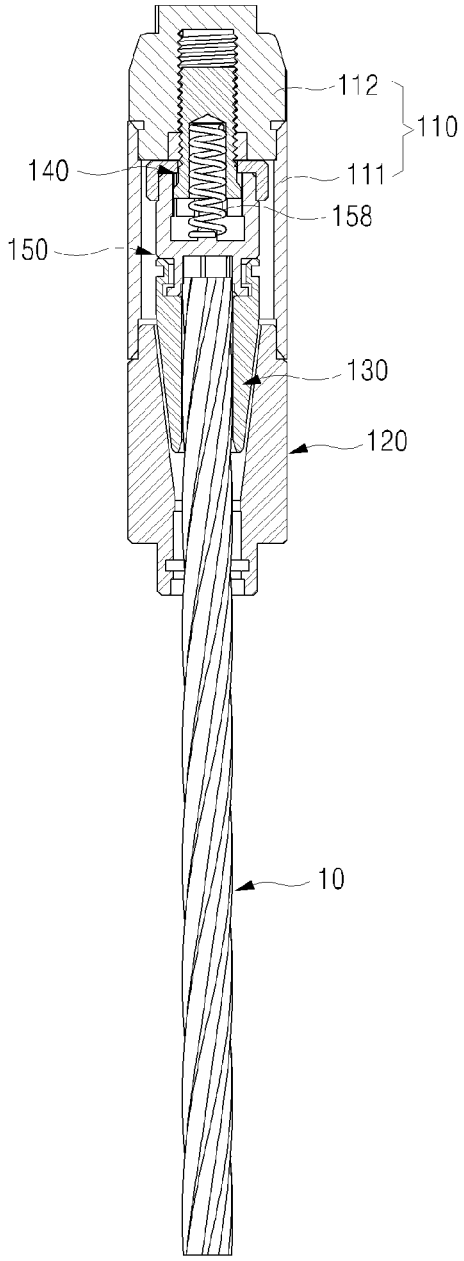
FIG. 5 is a sectional view illustrating a state after separating a removable ground anchor body using a rotation according to an embodiment of the present invention.

Hereinafter, a removable ground anchor body using a rotation according to an embodiment of the present invention will be described in detail referring to the drawings.

As shown in FIGS. 1 to 6, a removable ground anchor body 100 using a rotation of the present invention may include: a water-proof cap 110 in which guide screw grooves 113 are formed; a head coupler 120 which is to be connected to a lower side of the water-proof cap 110 and through which a taper hole 121 through which a pc strand 10 passes is formed in a length direction; a wedge 130 which is inserted into the taper hole 121 of the head coupler 120 to fix the pc strand 10; an operation member 140 which is formed with a screw bar 141 to be coupled to the guide screw grooves 113 of the water-proof cap 110, on a lower part of which below the screw bar 141 an octagonal flange 142 is formed and in which a guide groove 143 is formed from the lower end to upward; and a body 150 which is provided with a compression spring 158 to be inserted into the guide groove 143 of the operation member 140, on a lower part of which a wedge connection portion 151 is formed and on an upper part of which an operation portion 154 is formed wherein a key groove 155 and an idle portion 156 are formed upward and downward on the operation portion 154 such that the octagonal flange 142 of the screw bar 141 is inserted into the key groove 155 and the idle portion 156 to correspond selectively to the key groove 155 and the idle portion 156 depending on the location of the octagonal flange 142.

The water-proof cap 110 is provided with a first water-proof cap 111 in a tube shape and a second water-proof cap 112 for covering the upper end of the first water-proof cap 111 wherein the guide screw grooves 113 into which the operation member 140 is screw-connected are formed inside the second water-proof cap 112.

The head coupler 120 is connected to a lower side of the water-proof cap 110, and the taper hole 121 and a through hole 122 are formed to be communicated each other in the head coupler in a length direction such that the wedge 130 is guided through the taper hole 121 to fit and fix the pc strand 10 passing through.

The wedge 130 is inserted into the taper hole 121 of the head coupler 120, is divided into three parts in a length direction, and is provided with a connection means 131 such as elastic ring on an upper part and further it may be formed as a common shape where a groove and a flange are formed simultaneously on an upper side.

The operation member 140 is moved forward and rearward according to a rotation by screw-connecting the screw bar 141 to the guide screw grooves 113 of the water-proof cap 110, the octagonal flange 142 projecting outward is formed on a lower side of the screw bar, and the guide groove 143 of a predetermined depth is formed from a bottom center to upward.

The body 150 is provided with a compression spring 158 to be inserted elastically into the guide groove 143 of the operation portion 140 and the operation portion 154 and the wedge connection portion 151 are formed at an upper side and a lower side thereof, respectively.

Here, the wedge connection portion 151 is formed with a connection means 153 on which a groove and a flange are formed and which is coupled to a connection means 131 of the wedge 130 below the body 150 and a lower surface of which a key groove 152 into which an upper end of the pc strand or the deformed steel bar 10 is fitted and connected is formed such that the body 150 is rotated with interlocking to the rotation of the pc strand or the deformed steel bar 10.

Specially, the key groove 155 and the idle portion 156 are formed sequentially upward and downward on an upper part of the body 150 of the operation portion 154 and the octagonal flange 142 of the operation member 140 is inserted into the key groove 155 and the idle portion 156, and a support protrusion 155*a* projecting upward is formed at a center of a bottom surface of the key groove 155 and the idle portion 156 and the compression spring 158 is connected elastically to the support protrusion 155*a*.

Furthermore, the screw bar 141 is key-connected to the key groove 155 and the idle portion 156 of the operation portion 154 such that the screw bar is corresponded selectively to the key groove 155 and the idle portion 156 depending on the location of the octagonal flange 142 of the screw bar 141, and thus when the octagonal flange 142 is disposed in the key groove 155, the body 150 and the operation member 140 are interlocked such that the operation member is rotated or reverse-rotated according to the rotation of the body 150, and when the octagonal flange 142 is disposed on the idle portion 156, the body is only idle-rotated.

Additionally, a guide member 157 formed with a through hole 157*a* and a support piece 157*b* is connected to an upper part of the operation portion 154 to guide smoothly the operation member 140 arranged elastically and at the same time apply accurately elasticity of the compression spring 158 thereto.

Figure 6:
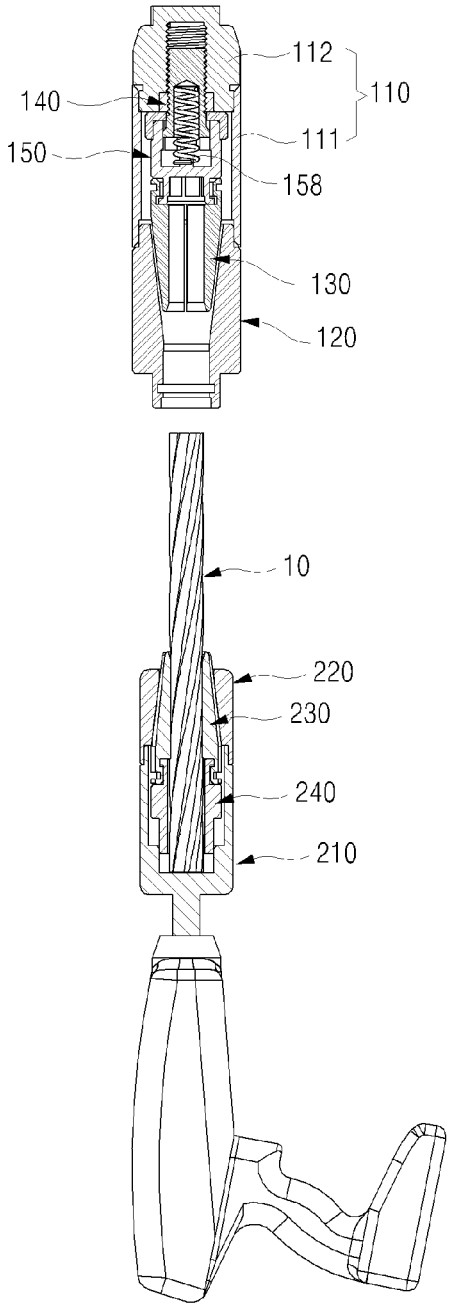
FIG. 6 is a sectional illustrating a separation state of removable ground anchor body using a rotation according to an embodiment of the present invention.
Figure 7:
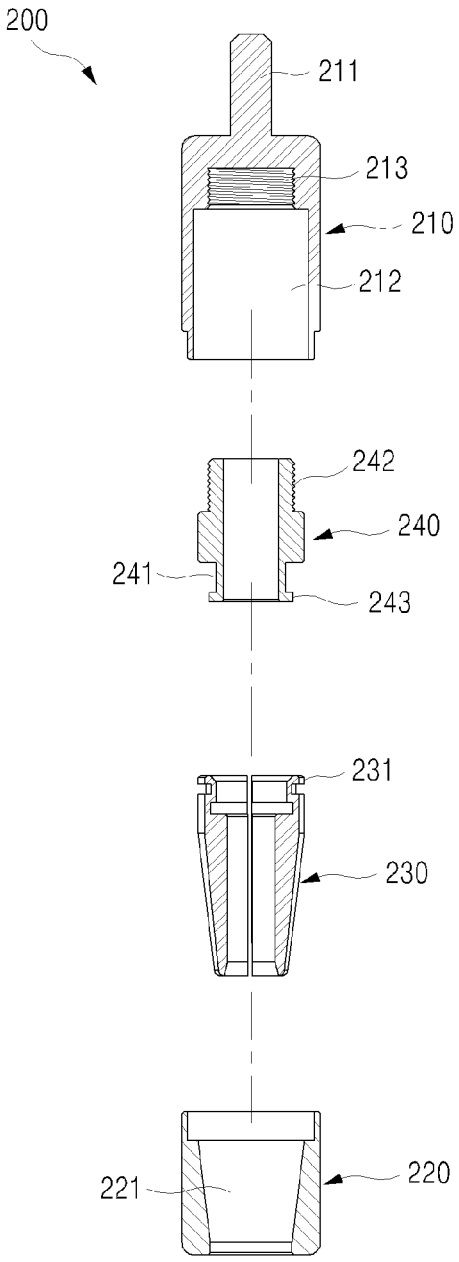
FIG. 7 is an exploded-sectional view illustrating a remover of a removable ground anchor body using a rotation according to an embodiment of the present invention.

Meanwhile, as shown in FIGS. 6 and 7, a removable ground anchor body 100 using a rotation according to an embodiment of the present invention may be provided with a remover 200 at a rear end of a pc strand or deformed steel bar 10, which is attachable and detachable.

Here, the remover 200 may include: a removing housing 210 in which guide screw grooves are formed; a head coupler 220 which is connected to a lower part of the removing housing 210 and through which a taper hole 221 through which the pc strand 10 passes is formed in a length direction; a wedge 130 which is inserted into the taper hole 221 of the head coupler 220 to fix the pc strand; and a removing body 240 which is arranged inside the removing housing 210, on which an operation screw 242 to be screw-connected to the guide screw grooves 213 is formed and on a lower part of which a wedge connection portion 241 is formed.

The removing housing 210 is formed with a connection bar 211 protruding therefrom to be connected easily to an instrument of a removing gun, an operation hole 212 inner part of which guide screw grooves 213 are formed is formed inside the removing housing 210 and the removing body 240 is inserted into the operation hole 212 of the removing housing 210 wherein the operation screw 242 is formed on the removing body 240 to be screw-connected to the guide screw grooves 213 and a wedge connection portion 241 on a lower part of which a connection means 243 is protruded is formed thereon.

The operations of the present invention will be described as followings.

Firstly, it can keep the fitting state of a front end of the pc strand or the deformed steel bar 10 into the key groove 152 of the body 150 after the pc strand or the deformed steel bar 10 passes through the taper hole 121 of the head coupler 120 and at the same time it can keep continuously the fitting state of the wedge 130 into the taper hole 121 of the head coupler 120 by compressing continuously the body 150 with the compression spring 158 so that a strong connection state of the pc strand or the deformed steel bar 10 can be kept continuously even though impact is applied thereto due to movement or getting off.

The anchor body 100 which is connected in the above state is inserted into the perforated-hole to implement various slope reinforcement constructions.

In special, according to the anchor body 100 of the present invention in a case of removing the pc strand or the deformed steel bar 10 after the grouting process, when the remover 200 is connected to a rear end of the pc strand or the deformed steel bar 10 and is rotated, the octagonal flange 142 disposed on the idle portion 156 is moved toward to the key groove 155 and key-connected thereto to interlock-rotate the screw bar 141 with elasticity of the compression spring 158 while the body 150 rotates.

Accordingly, the operation member 140 ascends due to the rotation of the screw bar 141 and is firstly separated from the pc strand or the deformed steel bar 10 and sequentially the octagonal flange 142 is caught over the through hole 157*a* of the guide member 157 to raise the body 150 and thus the wedge 130 which is connected to the pc strand or the deformed steel bar 10 in a fitting state ascends to release the connection state.

In this state, the remover 200 connected to a rear end of the pc strand or the deformed steel bar 10 is rotated with the removing gun to be separated from the perforated-hole.

Meanwhile, when intending to connect or re-connect the pc strand or the deformed steel bar 10, the pc strand or the deformed steel bar 10 is reverse-rotated in a reverse order while compressing the pc strand or the deformed steel bar 10.

Specially, since the octagonal flange 142 is disposed on the idle portion 156 at the time point when the connection is completed, it can be recognized easily and thus a proper connection state can be kept and the separation due to the decreasing of compression force can be prevent and further excessive compression can be prohibited.

Accordingly, according to the removable ground anchor body using a rotation, when a pc strand or a deformed steel bar is rotated, a screw bar is interlock-rotated to raise an operation member and sequentially raise a body and a wedge from the pc strand or the deformed steel bar thereby to release the connection state. Since an octagonal flange is disposed on an idle portion at the time point when the connection is completed, it can be recognized easily and thus a proper connection state can be kept and the separation due to the decreasing of compression force can be prevent and further excessive compression can be prohibited. Furthermore, the pc strand or the deformed steel bar can be separated and removed simply and at the same time connected fully to keep the strong connection state continuously and safely and re-connected conveniently and simply regardless of places even though the pc stand or the deformed steel bar is separated.

While embodiments have been shown and described above, it will be apparent to those skilled in the art that modifications and variations could be made without departing from the scope of the present inventive concept as defined by the appended claims.

What is claimed is:

1. A removable ground anchor body using a rotation, comprising:

a water-proof cap in which guide screw grooves are formed;

a head coupler which is to be connected to a lower side of the water-proof cap and through which a taper hole through which a pc (prestressed concrete) strand passes is formed in a length direction;

a wedge which is inserted into the taper hole of the head coupler to fix the pc strand;

an operation member which is moved forward and reward by screw-connecting a screw bar to the guide screw grooves of the water-proof cap due to the rotation, on a lower part of which below the screw bar an octagonal flange protruding outward is formed and in which a guide groove in a predetermined depth is formed from a bottom center to upward; and a body which is provided with a compression spring to be inserted into the guide groove of the operation member, on a lower part of which a wedge connection portion is formed and on an upper part of which an operation portion is formed, wherein a key groove and an idle portion are formed upward and downward on an operation portion such that the octagonal flange of the screw bar is inserted into the key groove and the idle portion to correspond selectively to the key groove and the idle portion depending on a location of the octagonal flange.

2. The removable ground anchor body of claim 1, wherein the water-proof cap is provided with a first water-proof cap in a tube shape and a second water-proof cap for covering an upper end of the first water-proof cap, wherein the guide screw grooves into which the operation member is screw-connected are formed inside the second water-proof cap, and the head coupler is connected to a lower side of the water-proof cap, and wherein the taper hole and a through hole are formed to be communicated with each other in the head coupler in a length direction.

3. The removable ground anchor body of claim 1, wherein the wedge connection portion of the body is formed with a connection means which is coupled to a connection means of the wedge and a lower surface of which a key groove is formed, and a support protrusion projecting upward is formed at a bottom center of the key groove and the idle portion of the operation portion and the compression spring is connected elastically to the support protrusion, and a guide member formed with a through hole and a support piece is connected to an upper part of the operation portion.

4. The removable ground anchor body of claim 1, further comprising a remover that is attachable and detachable to a rear end of the pc strand or a deformed steel bar, wherein the remover comprises:

a removing housing from which a connection bar is protruded to be connectable to a removing gun and in which an operation hole is formed, wherein guide grooves are disposed at an inner side of the operation hole;

a head coupler which is connected to a lower part of the removing housing and through which a taper hole through which the pc strand passes is formed in a length direction;

a wedge which is inserted into the taper hole of the head coupler to fix the pc strand; and a removing body which is arranged inside the operation hole of the removing housing, on which an operation screw to be screw-connected to the guide screw grooves is formed and on a lower part of which a wedge connection portion to which the wedge is connected is formed.

* * * * *